United States Patent [19]

Kashyap et al.

[11] 4,160,144

[45] Jul. 3, 1979

[54] SINGLE-SIDED MICROWAVE APPLICATOR FOR SEALING CARTONS

[75] Inventors: Satish C. Kashyap, Hazeldean; Walter Wyslouzil, Carlsbad Springs, both of Canada

[73] Assignee: Canadian Patents and Development Limited, Ottawa, Canada

[21] Appl. No.: 872,228

[22] Filed: Jan. 25, 1978

[51] Int. Cl.[2] ..... H05B 9/06

[52] U.S. Cl. ..... 219/10.55 A; 219/10.55 F; 333/227

[58] Field of Search ..... 219/10.55 A, 10.55 F, 219/10.55 M, 10.55 R, 10.55 D, 10.81; 333/83 R, 21 R, 98 R

[56] References Cited

U.S. PATENT DOCUMENTS

| | | | |
|---|---|---|---|
| 3,402,277 | 9/1968 | Muller | 219/10.55 F |
| 3,456,355 | 7/1969 | Cumming et al. | 219/10.55 A |
| 3,555,232 | 1/1971 | Bleackley | 219/10.55 A |
| 3,679,855 | 7/1972 | Binzer | 219/10.55 D |
| 3,783,221 | 1/1974 | Soulier | 219/10.55 A |
| 3,886,471 | 5/1975 | Massani et al. | 333/83 R |
| 3,999,026 | 12/1976 | Boling | 219/10.55 F |

*Primary Examiner*—Roy N. Envall, Jr.
*Assistant Examiner*—Philip H. Leung
*Attorney, Agent, or Firm*—Edward Rymek

[57] ABSTRACT

The single-sided microwave applicator has a section of a microwave waveguide with an open end for receiving microwave energy and an end which is electrically shorted. A slot is located in one of the wide sides of the waveguide extending along the center line from the shorted end. A conductive ridge is mounted within the waveguide extending upward from the other side through the slot. One end of the ridge is connected to the shorted end of the waveguide, while the other end of the ridge is tapered from a point within the slot. The slot is generally in the order of ¾ to 1 inch and at least 2½ inches long, when the operating frequency is 2450 MHz. Since one end of the waveguide is shorted, standing waves are produced resulting in a non-uniform field having at least one maximum along the length of the slot. The electric field produced is non-radiating and its strength diminishes exponentially above the slot.

5 Claims, 3 Drawing Figures

SINGLE-SIDED MICROWAVE APPLICATOR FOR SEALING CARTONS

BACKGROUND OF THE INVENTION

This invention is directed to a microwave heating device and in particular to a microwave applicator for sealing cardboard cartons.

Various industries use cardboard cartons for packaging their products (e.g. beer bottles, soup cans, etc.). The tops and bottoms of the boxes are commonly sealed by using molten hot melt. The hot melt for the bottom flaps is applied by a set of wheels dipping in a hot melt container kept at 350° F. The hot melt for the top flaps is applied through a set of nozzles. The flaps are then pressed together to seal the box while the hot melt is still soft. This system has various drawbacks. The nozzles invariably get clogged and tie up the production lines. The hot melt has to be either maintained at 350° F. at all times or long warm-up times are necessary after a weekend or an overnight shutdown.

To overcome these problems, it is proposed that the adhesive be applied during the carton manufacturing process. The carton may then be sealed by closing the flaps and heating the adhesive to reactivate the hot melt. This may presently be accomplished by applying a hot plate to the carton flaps, heating the adhesive and thereby sealing the carton when the adhesive cools. However, the use of hot plates in a packaging line would be impractical except for very thin cardboards.

It is therefore proposed that the adhesive be activated by applying microwave power to the carton where adhesive is present. U.S. Pat. No. 3,999,026 which issued on Dec. 21, 1976 to Boiling, teaches an applicator that consists of a resonator divided into at least two parallel chambers by a separating wall with the separating wall connected to a microwave energy source. The resonator further includes a slot in the resonator wall above the edge of the separating wall. This applicator produces even heating in a longitudinal heating area along the slot in the wall.

SUMMARY OF THE INVENTION

It is therefore an object of this invention to provide a non-resonant applicator.

It is a further object of this invention to provide an applicator having one or more predetermined maximum field areas or hot spots which coincide with glue lines.

These and other objects of this invention are achieved in a single-sided microwave applicator in which a section of rectangular microwave waveguide with two narrow sides and two wide sides, has an open end to receive microwave energy and a closed end which is electrically shorted. The rectangular waveguide section further has an elongated slot in the first wide side extending along the center line of the wide side from the shorted end of the waveguide section. The applicator further includes a conductive ridge mounted within the waveguide section along the center line of the second wide side. The ridge extends through the slot with one end in contact with the shorted end of the waveguide section. The other end of the ridge is tapered from a point within the slot to the second wide side of the waveguide. Standing waves in the applicator product a non-uniform electric field having at least one maximum along the slot between the ridge and the first wide side. The electric field produced is bound to the surface of the applicator and its strength diminishes exponentially above the slot.

In accordance with another aspect of the invention, the applicator includes a layer of dielectric material located on the outer surface of the first wide side to cover the slot. The dielectric material may preferrably be teflon.

Many other objects and aspects of the invention will be clear from the detailed description of the drawings.

DETAILED DESCRIPTION OF THE EMBODIMENTS

Figures 1, 2, 3:
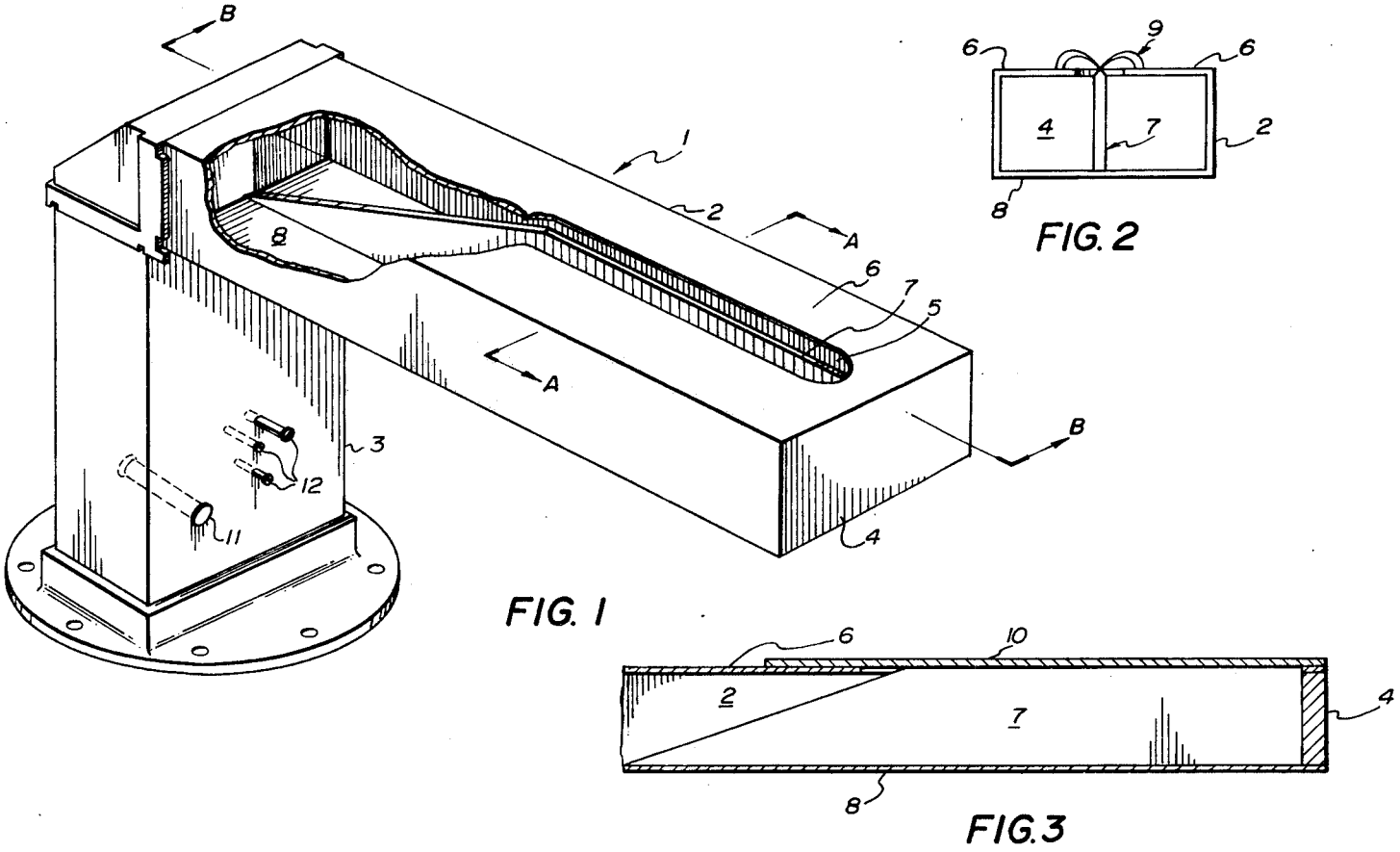
FIG. 1 illustrates the single-sided microwave applicator in accordance with this invention.
FIG. 2 is a cross-section of the applicator in FIG. 1 taken along line A—A.
FIG. 3 is a cross-section of the applicator in FIG. 1 taken along line B—B.

The single-sided microwave applicator 1 as illustrated in FIGS. 1, 2 and 3 includes a section 2 of waveguide which is energized directly by a microwave source (not shown) or via a further waveguide section 3 which is connected to a source. As in all commercial microwave devices, the power source operates at a commercial frequency, such as 2450 MHz. The configuration of the apparatus by which the applicator 1 is energized will depend on the particular use of the applicator in a packaging line.

The waveguide 2 is open at one end by which it receives energy and is shorted at the other end by a shorting block 4. A slot 5 is located in one wide side 6 of the waveguide 2. The slot 5 starts at or near the shorting block 4 and extends along the centerline of the waveguide for a predetermined length. A ridge 7 of conducting material is located within the waveguide 2 along its centerline. The bottom of the ridge 7 is fixed to one wide side 8 of the waveguide 2, the end of the ridge 7 is fixed to the shorting block 4. The top of the ridge extends to the top of the wide side 6 of the waveguide, one end being in contact with the first end of the slot 5 forming a short. The other end of the ridge 7 is tapered and is not in contact with the end of the slot 5.

The electric field 9 produced at the slot 5 when the applicator 1 is energized by a microwave power source is shown in FIG. 2. The electric field 9 is bound to the surface 6 of the applicator 1 and extends to only about a ¼ of an inch from the surface 6. There are standing waves in the applicator 1 and the resultant field along the length of the applicator slot 5 is not uniform. The hot spots created by the standing waves can be advantageously used to heat a flap with more than one adhesive spot or line. Spacing between the hot spots can be arranged, as will be discussed below, to suit requirements. A spacer 10 may be mounted on the wide side 6 of the waveguide to space the carton to be heated at an appropriate distance from the applicator 1 and to keep dirt and other foreign material from entering the waveguide 2, as shown in FIG. 3. The spacer 10 may be made from a dielectric material such as teflon.

As an example, an applicator 1 which can be used for sealing a carton having a single adhesive spot or line, may consist of a WR-284 waveguide section 2. The width and length of the slot 5 are 0.75 inches and 2.5 inches respectively. The ridge is 0.187 inches thick. The electric field strength along the length of the ridge is not uniform. It is minimum at the short, i.e. where the ridge 7 and the end of slot 5 are in contact, rises to a maximum at approximately 1.25 inches and again goes to a minimum at about 2.5 inches from the short. At 2.5 kilowatts, the applicator can seal pieces of cardboard together at about 20 feet a minute.

In another example, an applicator 1 which can be used for sealing a carton having four adhesive spots or lines, may also be made from a WR-284 waveguide section 2. The width and length of the slot 5 are 1 inch and 11 inches, respectively. The ridge is 0.187 inches thick. A 0.035 inch thick teflon spacer is affixed to the waveguide with a double-sided adhesive tape. This applicator 1 has four hot spots approximately 2.5 inches apart, however applicators having a different distance between the hot spots can also be made.

The applicator 1 is matched to the microwave source by conventional means such as a fixed post 11 in the waveguide 3 as well as triple screw tuner 12 under simulated operating conditions.

It is important that the mirowave applicator 1 achieve a strong seal in a reasonable time without damaging the top of the carton, in particular for cartons made from corrugated cardboard which is approximately ⅛ inch thick. Various applicator parameters affect this performance.

The choice of width of the slot is quite critical. If the slot is not wide enough, the top of the carton burns before the hot melt softens. If the slot is too wide, there is excessive leakage and the contents of the carton begin to have a larger effect on the match of the applicator to the microwave source, especially if the tops of metal cans or metal caps are located very close to the top of the carton. For corrugated cardboard cartons, the optimum slot 5 width was found to be approximately 1 inch.

The waveguide 2 width and the ridge thickness both affect the waveguide wavelength and therefore the distance between the hot spots. Reduction of waveguide 2 width tends to increase the distance between the hot spots. A similar effect is produced by reducing the width of the ridge 7. The distances between the hot spots for various combinations of waveguide width and ridge thickness are shown in Table I.

TABLE I

| Ridge Thickness (inches) | Waveguide Width (inches) | Distance Between Hot Spots (inches) |
|---|---|---|
| 0.125 | 2.84 | 2.40 |
| 0.125 | 1.84 | 2.60 |
| 0.1875 | 2.84 | 2.33 |
| 0.1875 | 1.84 | 2.55 |
| 0.1875 | 0.84 | 3.30 |
| 0.1875 | 0.625 | 3.72 |

The spacer 10 is used to keep dirt and other undesirable objects from entering the waveguide. However, for sealing cartons made from thick cardboard, such as corrugated cardboard, the spacer 10 serves another important function.

Without the spacer 10, the time required for sealing with microwave power is quite critical, i.e. the time margin between sealing the carton and burning the surface of the cardboard is very small. Table II shows how the time margin for sealing increases with the thickness of a teflon spacer 10. As the teflon thickness increases, the time margin increases, however, the time required for sealing also increases. Thus there is an optimum spacer thickness depending upon the speed at which the cartons must be sealed and the thickness of the cardboard.

TABLE II

| Teflon Thickness (inches) | Power Used (kW) | Min. Time for Sealing (seconds) | Max. Time for Sealing (seconds) | Ratio | Comment |
|---|---|---|---|---|---|
| 0.0 | 1 | — | 3.0 | — | Burn marks appear before sealing |
| 0.010 | 1 | — | 3.0 | — | " |
| 0.020 | 1 | 3.0 | 3.8 | 1.26 | Sealed |
| 0.035 | 1 | 4.0 | 7.0 | 1.75 | " |
| 0.062 | 1 | 4.5 | 8.0 | 1.77 | " |

Though table II shows power levels of 1 kW, other and higher power levels may be used.

Modifications to the above described embodiments of the invention can be carried out without departing from the scope thereof and therefore the scope of the present invention is intended to be limited only by the appended claims.

What is claimed is:

1. A single-sided microwave applicator comprising:

a section of rectangular microwave waveguide having two narrow sides and two wide sides, one end of the waveguide section being open to receive microwave energy for producing standing waves within the waveguide section and the other end of said waveguide section being shorted, the waveguide section further having an elongated slot in the first wide side, extending along the center line of the wide side from the shorted end of the waveguide section; and a conductive ridge mounted within the waveguide section along the center line of the second wide side, the ridge extending through the slot with one end in contact with the first wide side at the shorted end of the waveguide section and the other end of the ridge being tapered from within the slot to the second wide side of the waveguide, whereby a non-uniform electric field having at least one maximum is produced between the ridge and the first wide side.

2. A single-sided microwave applicator as claimed in claim 1 which further includes a layer of dielectric material located on the outer surface of the first wide side to cover the slot.

3. A single-sided microwave applicator as claimed in claim 2 wherein the dielectric material is teflon.

4. A single-sided microwave applicator as claimed in claim 1 wherein, for an operating frequency of 2450 MHz, the width of the slot is in the order of 0.75 to 1 inch.

5. A single-sided microwave applicator as claimed in claim 4 wherein the length of the slot is greater than 2.5 inches.

* * * * *